United States Patent [19]

Lew

[11] Patent Number: 4,961,574

[45] Date of Patent: Oct. 9, 1990

[54] EXERCISER FOR AERIAL MANEUVERS

[76] Inventor: Hyok S. Lew, 7890 Oak St., Arvada, Colo. 80005

[21] Appl. No.: 429,158

[22] Filed: Oct. 30, 1989

[51] Int. Cl.[5] ..... A63B 26/00; A63G 31/00

[52] U.S. Cl. ..... 272/109; 272/36; 272/144; 280/206

[58] Field of Search ..... 272/36, 109, 144, 93, 272/114, 115, 126, 33 R, 1 R, 134, 146; 434/55; 280/206

[56] References Cited

U.S. PATENT DOCUMENTS

| | | | |
|---|---|---|---|
| 3,006,645 | 10/1961 | Frazier | 272/109 |
| 3,141,669 | 2/1964 | Chul | 272/36 |
| 3,276,777 | 10/1966 | Pruitt | 272/36 |
| 4,618,145 | 10/1986 | Inada | 272/36 |
| 4,746,116 | 5/1988 | Inada | 272/144 |
| 4,799,667 | 1/1989 | Suchy | 272/36 |

*Primary Examiner*—Stephen R. Crow

[57] ABSTRACT

An apparatus for aerial bodily maneuvers comprises a harness securable to the lower torso of an exercising person, a first and second ring disposed in a coaxially retaining and rotatable arrangement therebetween about a first axis coinciding with the central axis of the combination of the two rings, wherein the harness is fastened to the first ring and the second ring is rotatively supported by a frame about a second axis perpendicular to the first axis, which frame is anchored to a base in a rotatable arrangement about a third axis perpendicular to the second axis.

8 Claims, 2 Drawing Sheets

EXERCISER FOR AERIAL MANEUVERS

BACKGROUND OF THE INVENTION

Demand for an apparatus that enables one to practice and perfect skills for bodily maneuvers in midair has been intensifying because more and more amateur and professional athletes as well as average people are finding that apparatus-assisted airborne bodily maneuvers are highly enjoyable as well as a beneficial training method and exercise. There are a few devices assisting people to learn and practice airborne bodily maneuvers available at the present time, which are bulky, ungainly and expensive without any exception.

BRIEF SUMMARY OF THE INVENTION

The primary object of the present invention is to provide a device that suspends a person in midair in an arrangement wherein the person is allowed to rotatively maneuver about three independent axes.

Another object is to provide an exerciser for aerial maneuvers comprising a harness securable to the lower torso of the exercising person, which harness is secured to a first ring rotatively supported by a second ring in a coaxial arrangement therebetween, wherein the second ring is rotatively supported by a frame about an axis perpendicular to the axis of rotation of the first ring, and the frame is rotatively supported by a base about an axis perpendicular to the axis of rotation of the second ring.

A further object is to provide an exerciser for aerial maneuvers wherein the first ring includes handle means and foot-hold means respectively supported by a pair of over-hanging structures extending from the first ring in two opposite directions respectively.

These and other objects of the present invention will become clear as the description thereof progresses.

BRIEF DESCRIPTION OF THE FIGURES

The present invention may be described with a great clarity and specificity by referring to the following figures.

DESCRIPTION OF THE ILLUSTRATED EMBODIMENTS

Figure 1:
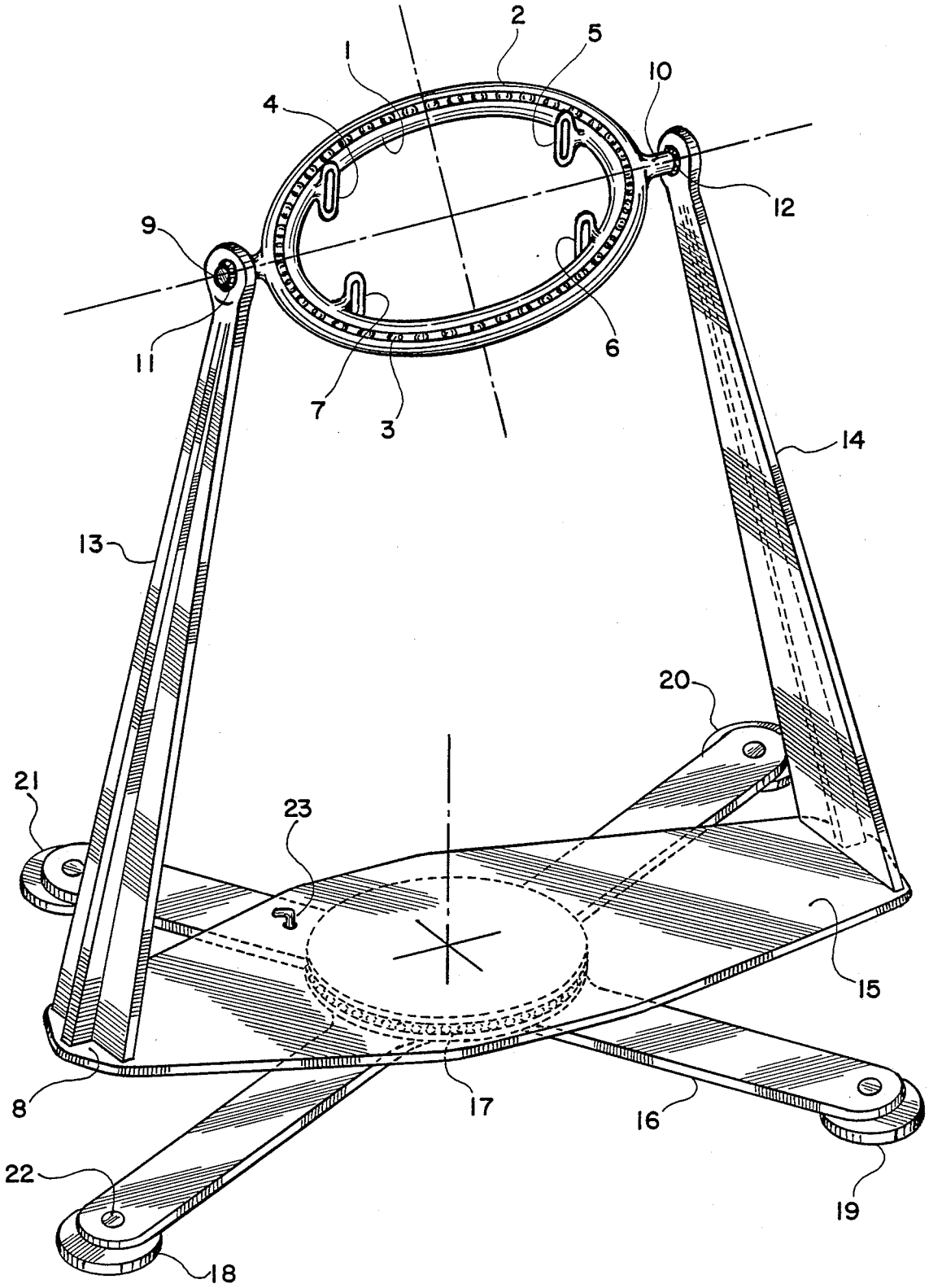
FIG. 1 illustrates a perspective view of an embodiment of the exerciser for aerial maneuvers of the present invention.

In FIG. 1 there is illustrated a perspective view of the exerciser for aerial maneuvers constructed in accordance with the principles of the present invention. A first ring 1 is disposed inside of a second ring 2 coaxially in a rotatable arrangement about the central axis of the combination thereof, wherein relative rotation therebetween is facilitated by a plurality of bearings or rollers 3. The first ring 1 includes a plurality of oblong rings 4, 5, 6 and 7 for securing the harness shown in FIG. 2 thereto. The second ring 2 is rotatively supported by a frame 8 in a retaining relationship by means of a pair of journals 9 and 10 extending in two opposite directions on a plane including the second ring 2 from two diametrically opposite portions of the second ring 2, which journals 9 and 10 respectively engage the bearings 11 and 12 respectively included in the extremities of two cantilevered structural members 13 and 14 extending from a support plate 15 of the frame 8. The support plate 15 of the frame 8 is rotatively anchored to a base structure 16 by means of a bearing 17 disposed therebetween on a plane parallel to the axis of rotation of the second ring 2 defined by the common central axis of the two journals 9 and 10. The base 16 may sit on a floor and is held in position by means of the friction provided by the four friction pads 18, 19, 20 and 21, or it may be anchored to a wall by means of screws engaging the holes 22 included in the food pads. A locking pin 23 prevents relative rotary movement between the frame 8 and the base 16 when it engages the hole included in the base 16 through a hole disposed through the support plate 15 of the frame 8. Of course, additional locking means preventing the rotating motion of the first ring 1 relative to the second ring 2 or that of the second ring 2 relative to the frame 8 may be employed in the construction of the exerciser for aerial maneuvers.

Figure 2:
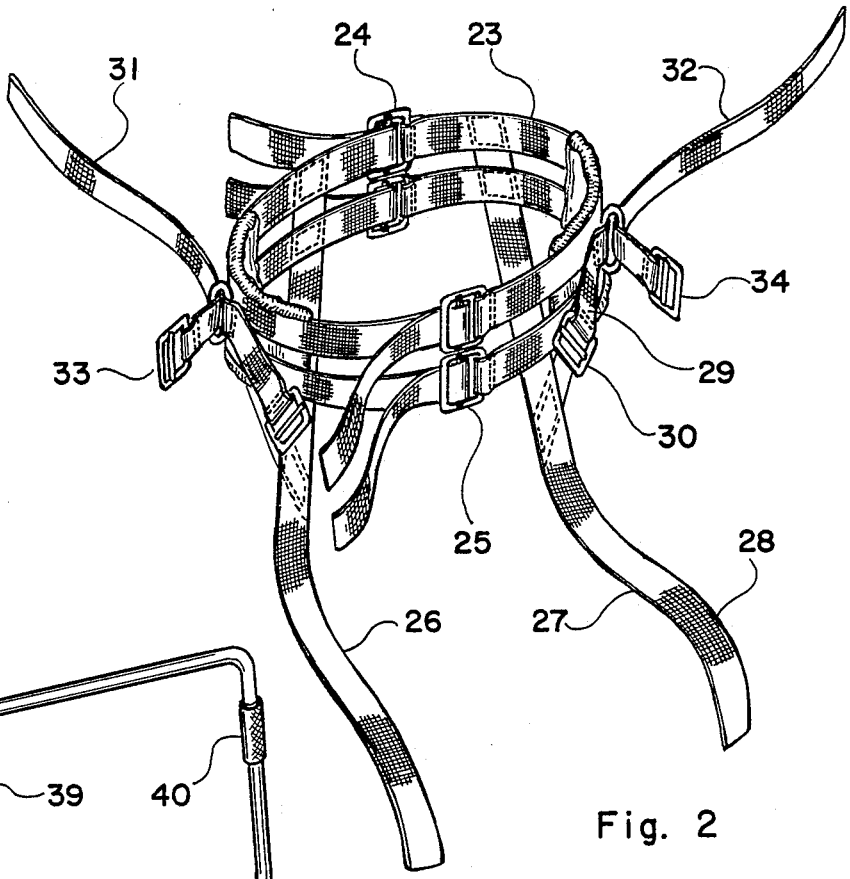
FIG. 2 illustrates a harness securable to the lower torso of an exercising person, which harness is usable in conjunction with the exerciser of aerial maneuvers.

In FIG. 2 there is illustrated a perspective view of an embodiment of the harness securable to the lower torso of an exercising person, which harness is to be fastened to the first ring 1 shown in FIG. 1. The harness comprises belt 23 to be worn around the lower torso or hip of the exercising person, that includes a pair of buckling means 24 and 25 respectively included in the rear and front halves of the belt 23. The harness also includes a pair of thigh straps 26 and 27, each of which comprises a first portion 28 laterally extending from one portion of the rear half of the belt 23 and a second portion 29 secured to one side of the belt 23, wherein the two portions of the thigh strap are removably joined by a buckling means 30. The two diametrical sides of the belt 23 respectively include a pair of fastener straps 31 and 32, each of which including a buckling means 34 is anchored to each of the two diametrically opposite sides of the belt 23. These fastener straps 31 and 32 are to engage the oblong rings 4, 5, 6 and 7 included in the first ring 1 shown in FIG. 1 in securing the harness to the first ring 1.

A person wearing the harness and suspended by the first ring 1 shown in FIG. 1 can perform aerial maneuvers comprising rotating motions about three independent axes; a first axis coinciding with the central axis of the first ring 1, a second axis coinciding with the central axis of the journals 9 and 10, and a third axis coinciding with the central axis of the bearing 17. The two buckling means 24 and 25 respectively included in the rear and front halves of the belt 23 of the harness and the fastener straps 31 and 34 of adjustable length facilitate people with girth of different sizes to use the common harness and the exerciser.

Figure 3:
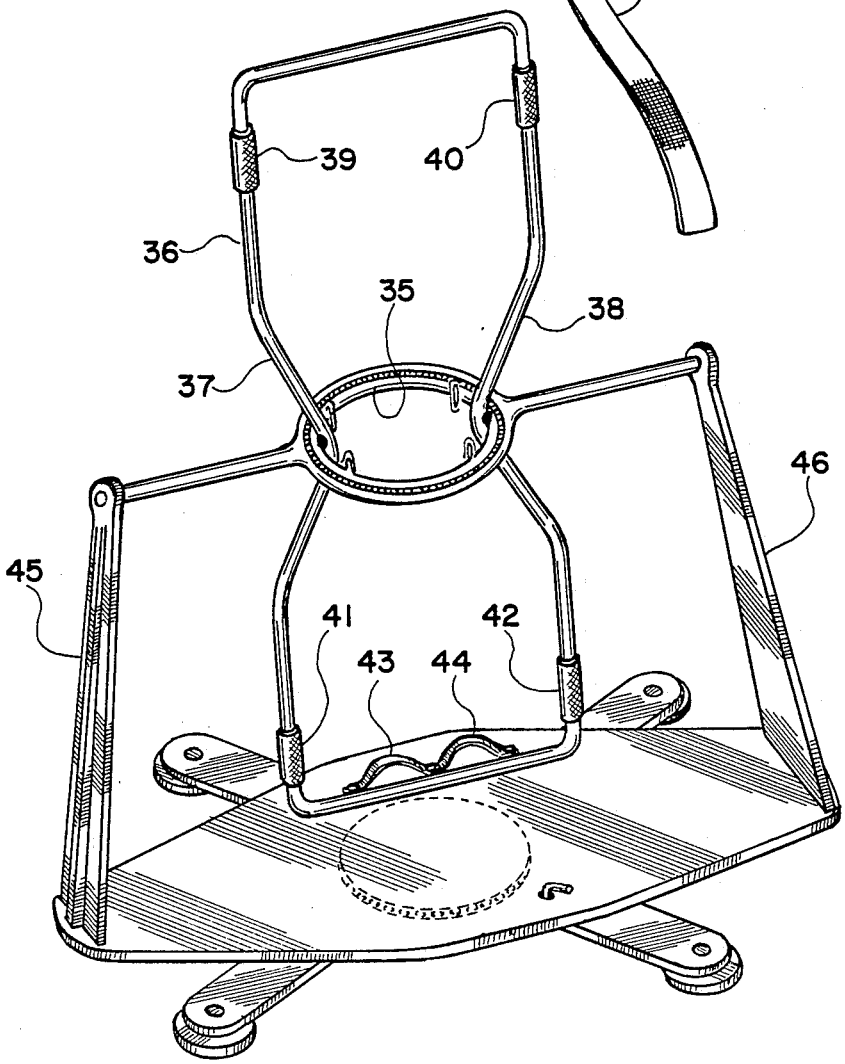
FIG. 3 illustrates a perspective view of another embodiment of the exerciser for aerial maneuvers.

In FIG. 3 there is illustrated another embodiment of the exerciser of aerial maneuvers, which has a construction essentially similar to the embodiment shown in FIG. 1 with one exception. The first ring 35 includes an oblong tubular frame 36 extending therethrough and disposed on a plane including the central axis of the first ring 35, wherein the two tubular members 37 and 38 of the oblong tubular frame 36 extending through the first ring 35 are respectively anchored to the two diametrically opposite portions of the first ring 35 where the two pairs of the oblong rings for fastening the harness are located respectively. The two extremities of the oblong tubular frame 36 may include variable length couplings 39, 40, 41 and 42, each of which couples and locks two sections of elongated tubular members in a telescoping arrangement. One extremity of the oblong tubular frame 36 with a pair of foot-holds 43 and 44 is used to anchor the feet of the exercising person, while the other extremity provides a handle to be grabbed by the exercising person. In this particular embodiment, the distance between the two cantilevered structural members 45 and 46 of the frame is opened up in order to provide enough clearance for the out-stretched arms of the exercising person performing a somersaulting movement therethrough.

While the principles of the present inventions have now been made clear by the illustrative embodiments, there will be many modifications of structures, arrangements, proportions, elements and materials immediately obvious to those skilled in the art, which are particularly adapted to the specific working environments and operating conditions in the practice of the invention without departing from those principles. It is not desired to limit the inventions to the particular illustrative embodiments shown and described and, accordingly, all suitable modifications and equivalents may be resorted to falling within the scope of the inventions as defined by the claims which follow.

I claim:

1. An apparatus for aerial maneuvers comprising in combination:

(a) first and second ring disposed coaxially coplanarly in a retaining and rotatable arrangement therebetween wherein the first ring is rotatable relative to the second ring about a first axis coinciding with the central axis of the first ring and the first ring includes fastening means for securing a harness disposed inside the first ring;

(b) a frame supporting the second ring in a rotatable arrangement about a second axis generally perpendicular to the first axis, wherein the combination of the first and second rings is rotatable about the second axis;

(c) a base having swivel means for anchoring the frame in a rotatable arrangement about a third axis generally perpendicular to the second axis; and (d) a harness including a belt securable around the lower torso of a person and a pair of thigh straps securable around thighs of the person, wherein said harness includes fastening means for securing the harness to the fastening means included in the first ring.

2. The combination as set forth in claim 1 wherein said combination includes locking means presenting relative rotating movements about the third axis between the frame and the base when the locking means is activated.

3. The combination as set forth in claim 1 wherein said combination includes an extension member providing a foot hold for the exercising person, which extension member is anchored to and extends from the first ring in a first direction generally perpendicular to a plane including the first ring.

4. The combination as set forth in claim 3 wherein said combination includes another extension member providing a handle for the exercising person, which extension member is anchored to and extends from the first ring in a second direction opposite to said first direction.

5. The combination as set forth in claim 4 wherein said combination includes locking means preventing relative rotating movements about the third axis between the frame and the base when the locking means is activated.

6. An apparatus for acrobatic exercising comprising in combination:

(a) first and second rings disposed coaxially coplanarly in a retaining and rotatable arrangement therebetween wherein the first ring is rotatable relative to the second ring about a first axis coinciding with the central axis of the first ring and the first ring includes fastening means for securing a harness disposed within the first ring;

(b) a frame with a base structure having swivel means for supporting the second ring in a rotatable arrangement about a second axis generally perpendicular to the first axis, wherein the combination of the first and second rings is rotatable about the second axis; and (c) a harness including a belt securable around the lower torso of a person and a pair of thigh straps securable around thighs of the person, wherein said harness includes fastening means for securing the harness to the fastening means included in the first ring.

7. The combination as set forth in claim 6 wherein said combination includes an extension member providing afoot hold for the exercising person, which extension member is anchored to and extends from the first ring in a first direction generally perpendicular to a plane including the first ring.

8. The combination as set forth in claim 7 wherein said combination includes another extension member providing a handle for the exercising person, which extension member is anchored to and extends from the first ring in a second direction opposite to said first direction.

* * * * *